US009714558B2

(12) United States Patent
Barker et al.

(10) Patent No.: US 9,714,558 B2
(45) Date of Patent: Jul. 25, 2017

(54) OPEN HOLE EXPANDABLE JUNCTION

(71) Applicant: Weatherford Technology Holdings, LLC, Houston, TX (US)

(72) Inventors: Ronald Gordon Barker, Magnolia, TX (US); Douglas Brian Farley, Missouri City, TX (US); William Clifford Hogg, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 241 days.

(21) Appl. No.: 14/614,100

(22) Filed: Feb. 4, 2015

(65) Prior Publication Data

US 2015/0226042 A1 Aug. 13, 2015

Related U.S. Application Data

(60) Provisional application No. 61/937,053, filed on Feb. 7, 2014.

(51) Int. Cl.

| | |
|---|---|
| ***E21B 43/10*** | (2006.01) |
| ***E21B 29/06*** | (2006.01) |
| ***E21B 41/00*** | (2006.01) |
| ***E21B 7/04*** | (2006.01) |
| ***E21B 47/04*** | (2012.01) |

(52) U.S. Cl.

CPC ..... *E21B 43/108* (2013.01); *E21B 7/046* (2013.01); *E21B 29/06* (2013.01); *E21B 41/0042* (2013.01); *E21B 43/103* (2013.01); *E21B 47/04* (2013.01)

(58) Field of Classification Search

CPC .... E21B 29/06; E21B 41/0042; E21B 43/103; E21B 43/108; E21B 47/04; E21B 7/046

USPC ..... 166/381; 175/62

See application file for complete search history.

(56) References Cited

U.S. PATENT DOCUMENTS

| | | | | |
|---|---|---|---|---|
| 2004/0168808 | A1 | 9/2004 | Smith | |
| 2005/0145387 | A1 | 7/2005 | Hocking | |
| 2009/0166040 | A1 | 7/2009 | Cavender et al. | |
| 2012/0125635 | A1* | 5/2012 | Watson | E21B 29/00 166/382 |
| 2014/0209306 | A1* | 7/2014 | Hughes | E21B 23/02 166/279 |

FOREIGN PATENT DOCUMENTS

| | | | |
|---|---|---|---|
| WO | 0046484 | A1 | 8/2000 |

OTHER PUBLICATIONS

EPO Extended European Search Report dated Jun. 10, 2015, for European Patent Application No. 15154128.1.

Canadian Office Action dated Feb. 5, 2016, for Canadian Patent Application No. 2,880,944.

* cited by examiner

*Primary Examiner* — Taras P Bemko

(74) *Attorney, Agent, or Firm* — Patterson & Sheridan, LLP

(57) ABSTRACT

A method for forming a lateral junction in an open hole section of a wellbore includes lowering a tubular member through a cased section of the wellbore. Thereafter, the tubular member is expanded in an open hole section of the wellbore, thereby anchoring the tubular member in the wellbore in a manner that leaves an open hole section of the wellbore between the expanded, tubular member and the cased section. Thereafter, a window is formed in a sidewall of the tubular member, and a lateral wellbore is drilled through the window.

20 Claims, 7 Drawing Sheets

OPEN HOLE EXPANDABLE JUNCTION

CROSS-REFERENCE TO RELATED APPLICATIONS

This application claims benefit of U.S. Provisional Patent Application Ser. No. 61/937,053, filed Feb. 7, 2014, which application is hereby incorporated by reference herein.

BACKGROUND OF THE INVENTION

Field of the Invention

Embodiments of the invention generally relate to lining an open hole section or sections of a wellbore. More specifically, embodiments of the invention relate to apparatus and methods for lining an open hole section or sections of a wellbore to form a junction where a lateral wellbore may be formed.

Description of the Related Art

Lateral wellbores are routinely used to more effectively and efficiently access hydrocarbon-bearing formations. Typically, the lateral wellbores are formed from a window that is formed in the casing of a central or primary wellbore, typically referred to as a junction. However, in some drilling applications, the casing may not extend completely along the primary wellbore due to costs, complexity, among other factors, and production is facilitated by an open hole wellbore that is not completely cased.

When forming a lateral wellbore in an open hole environment, it is difficult to maintain stability due to erosion at the junction. This instability compromises depth control for selective intervention, isolation and production. For example, it is difficult to maintain zonal isolation between formations and/or multiple lateral wellbores without having a known inside diameter where a seal may be positioned.

There is a need therefore, for an improvement in the integrity of the wellbore that facilitates lateral wellbore formation and a known sealing surface without using expensive and complex cased hole design techniques.

SUMMARY OF THE INVENTION

Embodiments of the invention provides methods for lining an open hole section or sections of a wellbore. In one embodiment, a method for lining an open hole section of a wellbore includes lowering a tubular member through a cased section of the wellbore, expanding the tubular member in an open hole section of the wellbore, thereby anchoring the tubular member in the wellbore, forming a window in a sidewall of the tubular member, and drilling a lateral wellbore through the window.

In another embodiment, a method for lining an open hole section of a primary wellbore includes drilling a primary wellbore to a first depth, casing a first section of the primary wellbore from the surface to a second depth that is less than the first depth, running-in a first tubular through the first section to a third depth that is greater than the first depth and less than the second depth, expanding the first tubular within the primary wellbore and anchoring the first tubular in the primary wellbore, forming a window in a sidewall of the first tubular, and drilling a second wellbore through the window.

In another embodiment, a method for lining an open hole section of a wellbore includes running-in a first tubular member through a cased section of a primary wellbore, expanding the first tubular member in an open hole section of the primary wellbore thereby anchoring the tubular member to the primary wellbore, wherein an uncased section of the primary wellbore is disposed between the cased section and the first tubular member, anchoring the first tubular member in the primary wellbore, forming a window in a sidewall of the first tubular member, and drilling a first lateral wellbore through the window, wherein the first tubular member comprises at least one anchor section and a window section.

DETAILED DESCRIPTION OF THE DRAWINGS

So that the manner in which the above recited features, advantages and objects of embodiments of the invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF EMBODIMENT OF THE INVENTION

Figure 1A:
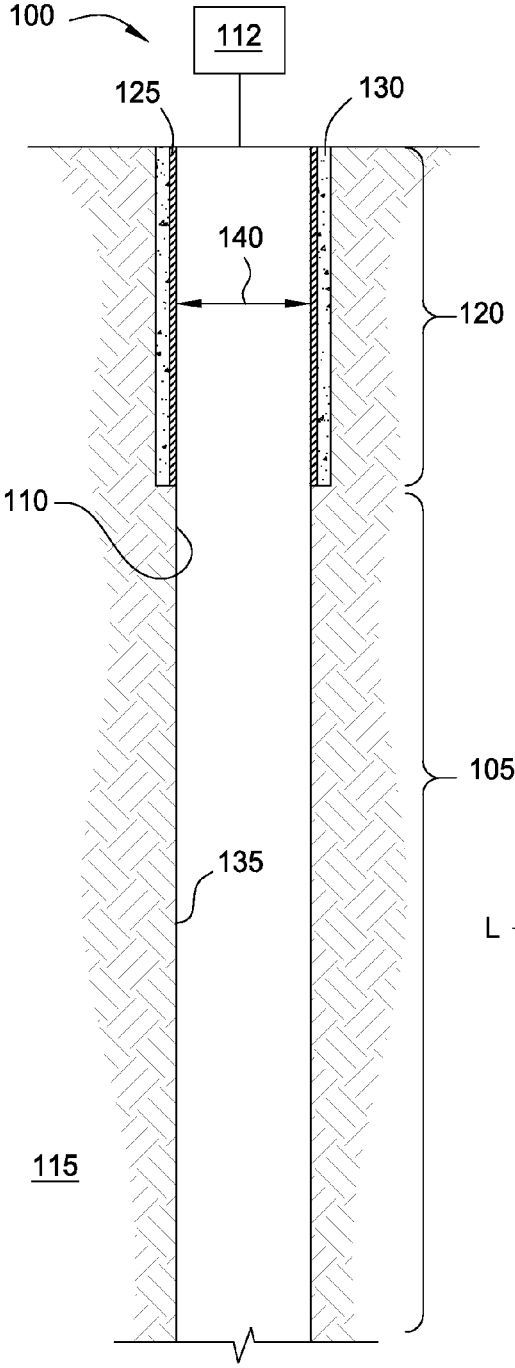
FIGS. 1A-5 are section views representing one embodiment of a method for cladding an open hole section of a primary wellbore to form a junction for a lateral wellbore.

Embodiments of the invention generally relate to lining an open hole section or sections of a wellbore. Embodiments of the invention also relate to apparatus and methods for lining an open hole section or sections of a wellbore to form a junction where a lateral wellbore may be formed. Embodiments of the invention also relate to improving isolation between the primary wellbore and lateral wellbores, as well as between multiple lateral wellbores and/or between formations. While the invention is exemplarily described for use in wells for hydrocarbon production, the invention may also be utilized with other wells, such as geothermal wells.

FIGS. 1A-5 are section views representing one embodiment of a method 100 for cladding an open hole section 105 of a primary wellbore 110 to form a junction for a lateral wellbore. The primary wellbore 110 may be coupled to a wellhead 112 at the surface. The open hole section 105 and the primary wellbore 110 may be a parent wellbore where one or more laterals maybe formed therefrom to access hydrocarbons within a reservoir 115. The primary wellbore 110 may also include a cased section 120 that extends from the surface and ends at the open hole section 105. The cased section 120 may include a casing 125, and cement 130 may be provided between a wall of the primary wellbore 110 and the casing 125. The open hole section 105 comprises an inner diameter that is defined by a wall 135 of the primary wellbore 110. In one embodiment, the open hole section 105 and an inner diameter 140 of the casing 125 defines a monobore, wherein the inner diameter of the open hole section 105 and the inner diameter 140 of the casing 125 are substantially equal. The casing 125 may be 13⅝ inch casing, 9⅝ inch casing, 8½ inch casing, or 7 inch casing, and the inner diameter of the open hole section 105 may be substantially equal to the inner diameter 140 of the casing 125.

Figure 1B:
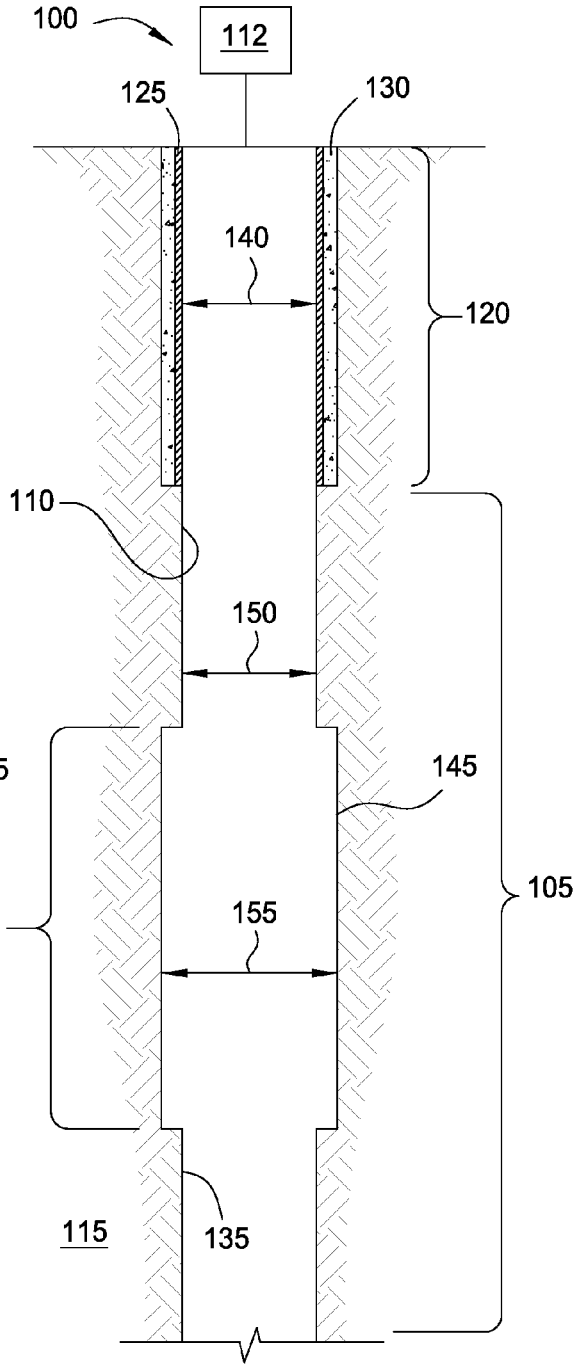

FIG. 1B shows a portion of the open hole section 105 of FIG. 1 where the wall 135 of the primary wellbore 110 is under-reamed to form an under-reamed section 145 in preparation for installation of a tubular cladding. The under-reamed section 145 may be formed in the primary wellbore 110 at a depth (or distance from the wellhead 112) where the wall 135 is unstable and/or in a region where the formation is reactive with drilling fluids. Alternatively or additionally, the under-reamed section 145 may be formed at a depth (or distance from the wellhead 112) where a lateral wellbore may be formed.

An inner diameter 150 of the open hole section 105 may comprise a first diameter and the under-reamed section 145 may be formed to a second diameter 155 that is greater than the first diameter of the open hole section 105. In one example, the inner diameter 150 of the open hole section 105 is about 9 inches (based on the inner diameter 140 of the casing 125) and the inner diameter of the under-reamed section 145 may be about 10 inches. A length L of the under-reamed section 145 may be greater than a length (i.e., an expanded length) of a to-be-installed tubular cladding in the open hole section 105. The length L may be longer than the to-be-installed tubular cladding to ensure sufficient space for tools and/or operations that may be used in the primary wellbore 110 after the tubular cladding is installed.

Figure 2:
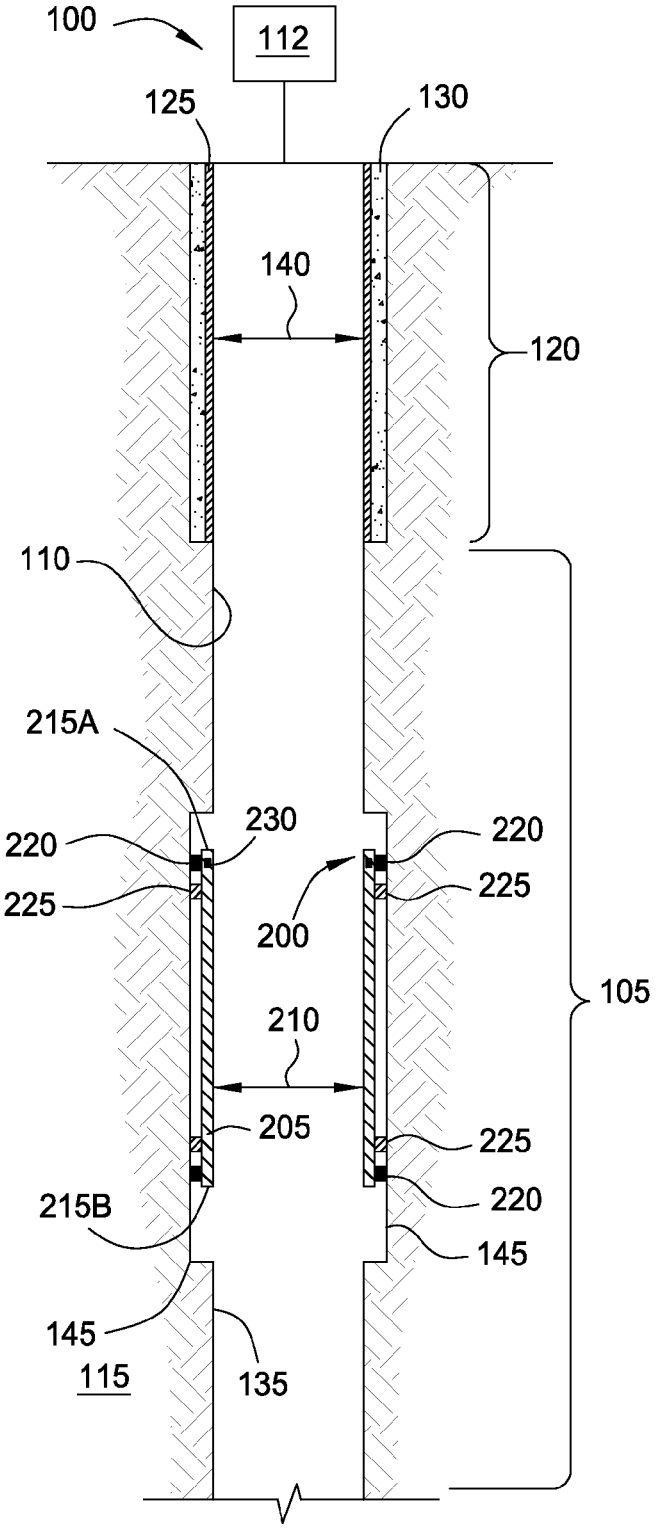

FIG. 2 shows a portion of the open hole section 105 wherein a cladding 200 has been installed in the under-reamed section 145 of FIG. 1B. As illustrated, the cladding 200 may be installed at a location within the open hole section 105 such that there is an uncased or open hole wellbore section disposed between the lower end of the casing 125 and the upper end of the cladding 200. The cladding 200 may be one or more sections of an expandable (tubular) member 205 that is anchored to the wall 135 of the primary wellbore 110. The cladding 200 may be positioned in the primary wellbore 110 at a depth (or distance from the wellhead 112) where the wall 135 is unstable and/or in a region where the formation is reactive with drilling fluids. Alternatively or additionally, the cladding 200 may be positioned at a depth (or distance from the wellhead 112) where a lateral wellbore may be formed. The cladding 200 may be lowered into the primary wellbore 110 and expanded using conventional bottom-up or top-down expansion methods, such as a swage/cone system, a jacking system, hydraulic expansion, and the like. The inner diameter 210 of the cladding 200 may be expanded to a diameter that is substantially equal to the inner diameter 140 of the casing 125 and/or the inner diameter of the wall 135 of the primary wellbore 110.

The cladding 200 may include terminal ends, such as an uphole end 215A and a downhole end 215B. One or both of the uphole end 215A and the downhole end 215B may include an anchor structure 220. Alternatively or additionally, one or both of the uphole end 215A and the downhole end 215B may include a seal 225. Examples of an anchor structure 220 are shown in FIGS. 6A-6E. Seals 225 may be an elastomeric material that may be used alone or in conjunction with the anchor structures 220.

The cladding 200 may also include a marker 230 disposed on one or both of the uphole end 215A and the downhole end 215B thereof. In the embodiment shown, the marker 230 is disposed on the uphole end 215A of the cladding 200. As the location of the downhole end 215B may be known during run-in of the cladding 200, the precise location of the uphole end 215A may not be known due to linear contraction of the cladding 200 during expanding of the cladding 200. Thus, the marker 230, which may be a radio frequency identification device, a magnetic device or a radioactive marker such as a pip tag, provides location information of the uphole end 215A which may be used to determine the location of a window for a subsequent lateral wellbore formation process.

Figure 3:
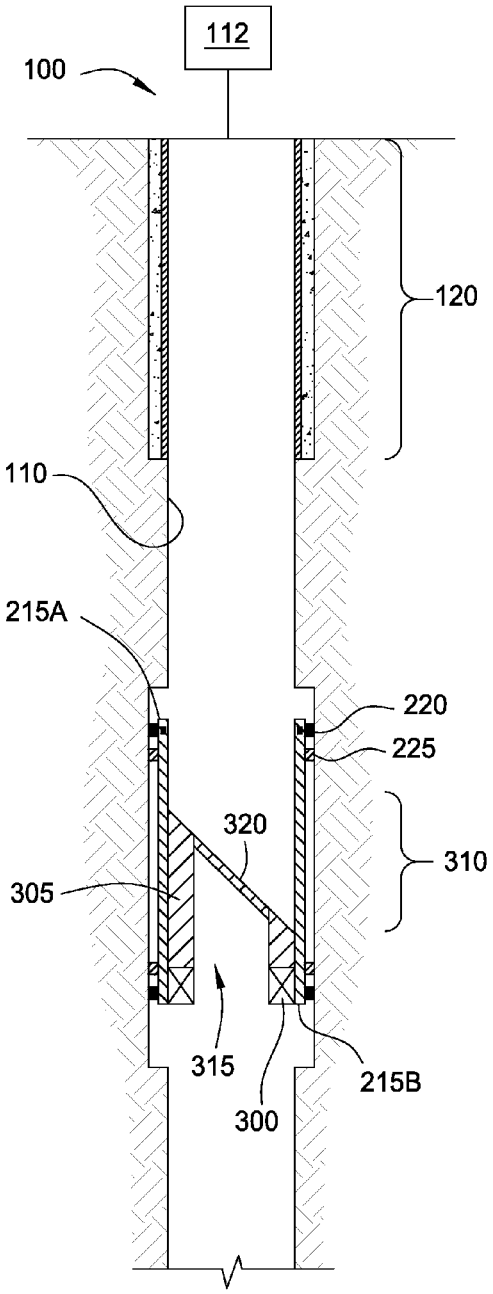

FIG. 3 shows the setting of a packer 300 and a whipstock 305 in the cladding 200. The packer 300 and whipstock 305 may be set by utilizing a tubular or wire/slick line-type string as is known in the art for the formation of a window in the area 310 of the cladding 200. The whipstock 305 includes a solid face 320 that is angled in order to deflect the drilling assembly used to drill a to-be-formed lateral. The packer 300 and whipstock 305 may both include a through-bore 315 to allow for production in zones below the packer 300 when the solid face 320 is drilled out (after formation of the lateral). The whipstock 305 is used to facilitate formation of the window by a milling process in the area 310. The whipstock 305 may be oriented within the cladding 200 such that the solid face 320 is positioned to direct the drilling assembly toward the area 310, The area 310 may be perforated to assist in formation of the window. When the area 310 is perforated, the cladding 200 may be oriented within the primary wellbore 110 prior to expansion of the cladding 200.

Figure 4:
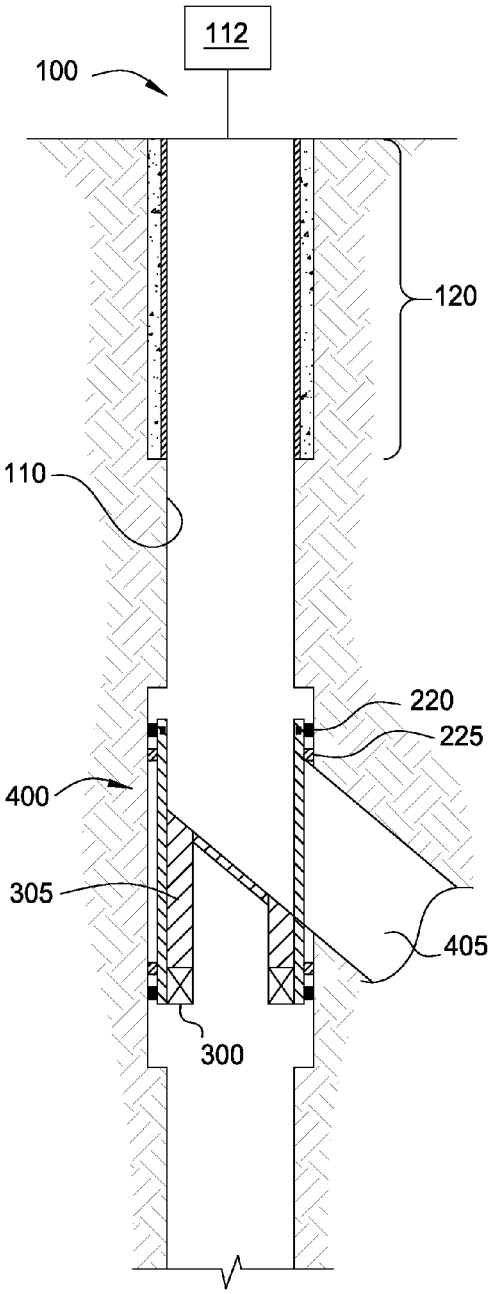
Figure 5:
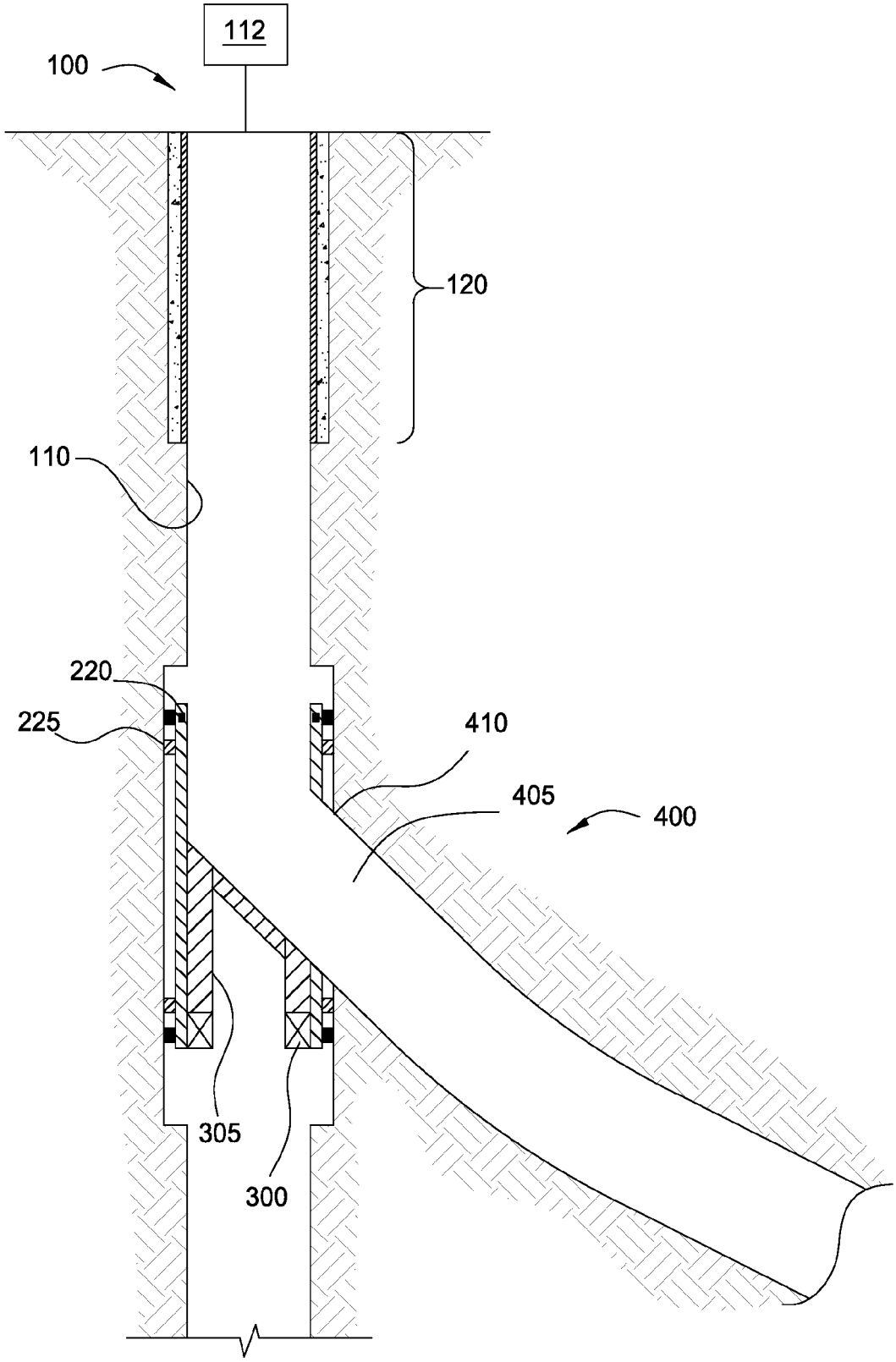

FIG. 4 shows an open hole junction 400 by the formation of a lateral wellbore 405. A window 410 may be formed through the cladding 200 using a mill to form the lateral wellbore 405. FIG. 5 shows the further drilling of the lateral wellbore 405 that is angled relative to the primary wellbore 110.

Figure 6A:
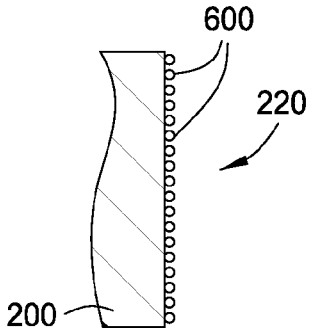
FIGS. 6A-6E show various embodiments of anchor structures that may be used with the cladding as described herein.
Figure 6C:
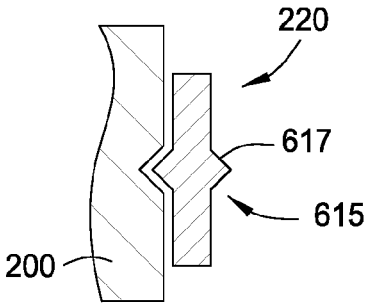
Figure 6B:
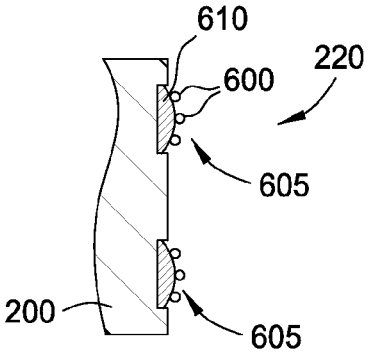
Figure 6D:
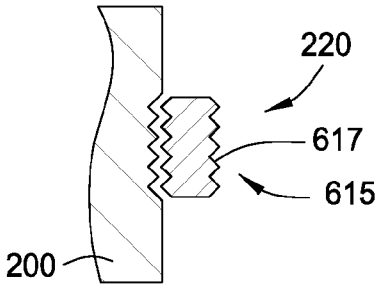
Figure 6E:
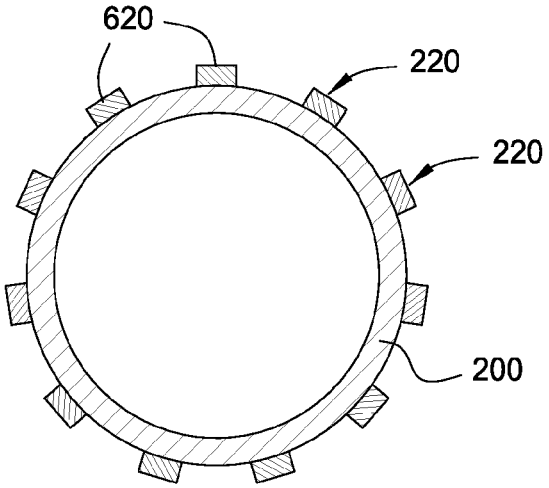

FIGS. 6A-6E show various embodiments of anchor structures 220 that may be used with the cladding 200 as described herein. FIGS. 6A-6D are side cross-sectional views of the cladding 200 and the anchor structure 220, and FIG. 6E is a cross-sectional plan view of the cladding 200 showing another embodiment of an anchor structure 220.

FIG. 6A shows an anchor structure 220 comprising a plurality of abrasive particles 600 disposed on an outer surface of the cladding 200. FIG. 6B shows an anchor structure 220 comprising a plurality of grip members 605. Each of the grip members 605 include an elastomeric portion 610 and an abrasive portion disposed thereon, such as a plurality of abrasive particles 600. The elastomeric portion 610 utilized with the grip members 605 may also provide a sealing aspect to the grip members 605. The abrasive particles 600 may include materials that are harder than the material of the cladding 200, such as a carbide material. FIGS. 6C and 6D show other embodiments of an anchor structure 220 that may include a carbide inserts 615 having one or more gripping members 617. The one or more gripping members 617 may be teeth utilized for gripping the cladding 200 and/or the surrounding formation, and preventing lateral movement of the cladding 200 within the wellbore. FIG. 6E shows another embodiment of an anchor structure 220 comprising one or more longitudinally oriented strips 620 disposed on the outer surface of the cladding 200. It is noted that any a combination of the anchor structures 220 shown in FIGS. 6A-6E may be combined for use with the cladding 200. Additionally, seals may be used in combination with any of the anchor structures 220.

Figure 7:
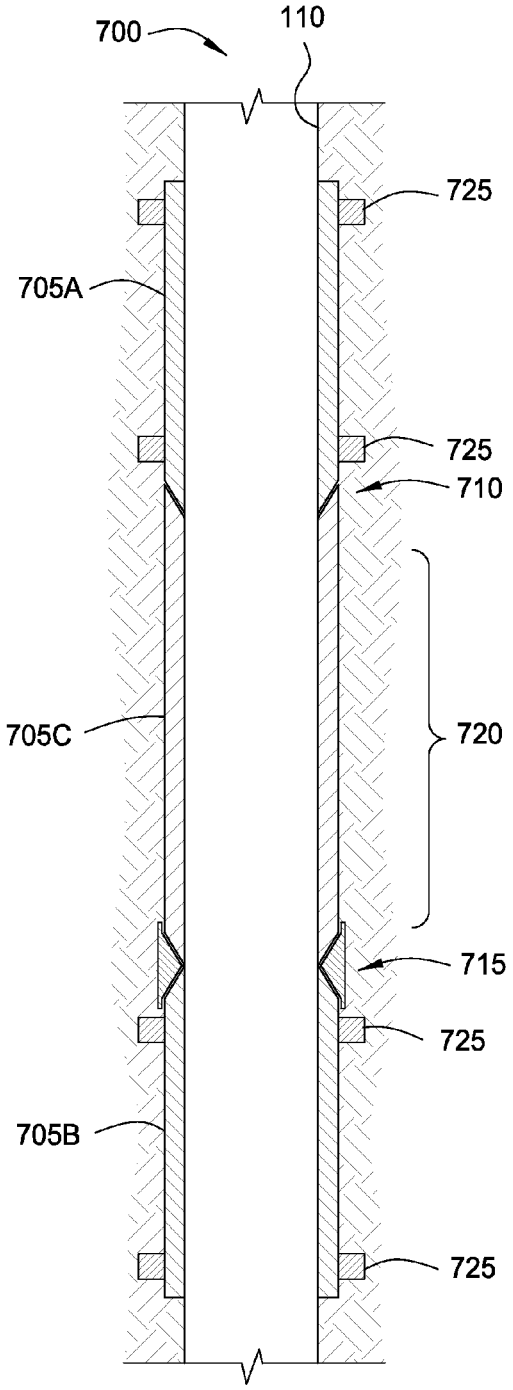
FIG. 7 is a side cross-sectional view of another embodiment of a cladding that may be used in place of the cladding shown in FIGS. 2-5.

FIG. 7 is a side cross-sectional view of another embodiment of a cladding 700 that may be used in place of the cladding 200 shown in FIGS. 2-5 to form the open hole junction 400. The cladding 700 includes multiple tubular sections shown as anchor sections 705A and 705B having a window section 705C therebetween. Each of the sections 705A-705C may be expandable members that are run-in and set in the primary wellbore 110 using conventional expandable methods. Each of the sections 705A-705C may include various coupling mechanisms, such as a pin and box coupler 710 or a pin-pin coupling 715. A lateral wellbore may be formed in area 720 of the window section 705C by the process described in FIGS. 3-5. The anchor sections 705A and 705B are used to stabilize the window section 705C. At least the anchor sections 705A and 705B include contact structures 725 that may be one or a combination of anchor structures 220 and seals 225 as described herein. Depending on the modulus of elasticity of the formation, contact structures 725 may also be used on the window section 705C.

In one embodiment, the window section 705C comprises an expanded length of about 30 feet, or greater, and the anchor sections 705A, 705B comprise an expanded length of about 10 feet, or greater. The lengths of the sections 705A-705C provide enough space to mill a window having a length of about 20 feet in order to form a lateral wellbore.

Figure 8:
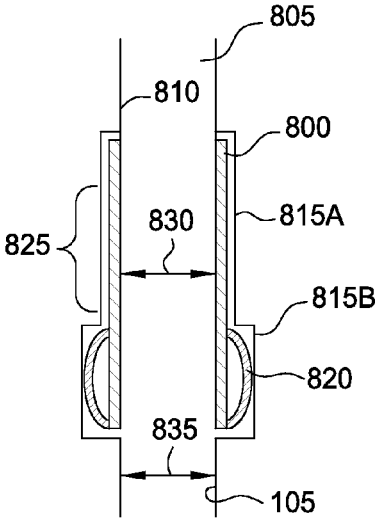
FIG. 8 is a side cross-sectional view of another embodiment of a cladding expanded in a wellbore.

FIG. 8 is a side cross-sectional view of another embodiment of a cladding 800 expanded in a wellbore 805. The cladding 800 may be one or more joints of an expandable tubular. However, a wall 810 of the wellbore 805 is under reamed to a first diameter 815A that receives a portion of the cladding 800, and a second diameter 815B is formed below the first diameter 815A. The second diameter 815B may be used to accommodate a centering anchor 820. A window may be formed in an area 825 by milling the cladding 800 to form an open hole junction. While the centering anchor 820 is shown below the area 825, an additional centering anchor (and second diameter) may be formed above the area 825. The second diameter 815B may be greater than the first diameter 815A. As an example, the first diameter 815A may be a 9⅝ inch under-ream while the second diameter 815B may be a 10¾ inch under-ream. In one embodiment, the expanded inner diameter 830 of the cladding 800 is substantially equal to an inner diameter 835 of the wellbore 805.

Figure 9:
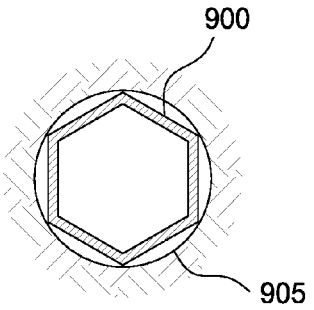
FIG. 9 is a top cross-sectional view of another embodiment of a cladding expanded in a wellbore.

FIG. 9 is a top cross-sectional view of another embodiment of a cladding 900 expanded in a wellbore 905. In this embodiment, the cladding 900 is expanded into a hex shape to enhance frictional contact between the cladding 900 and the wellbore 905. Anchor members and/or seals may be used on the cladding 900 to further increase frictional contact. The cladding 900 may be used as the cladding 200 described in FIGS. 2-5 or the cladding 700 described in FIG. 7.

Figure 10:
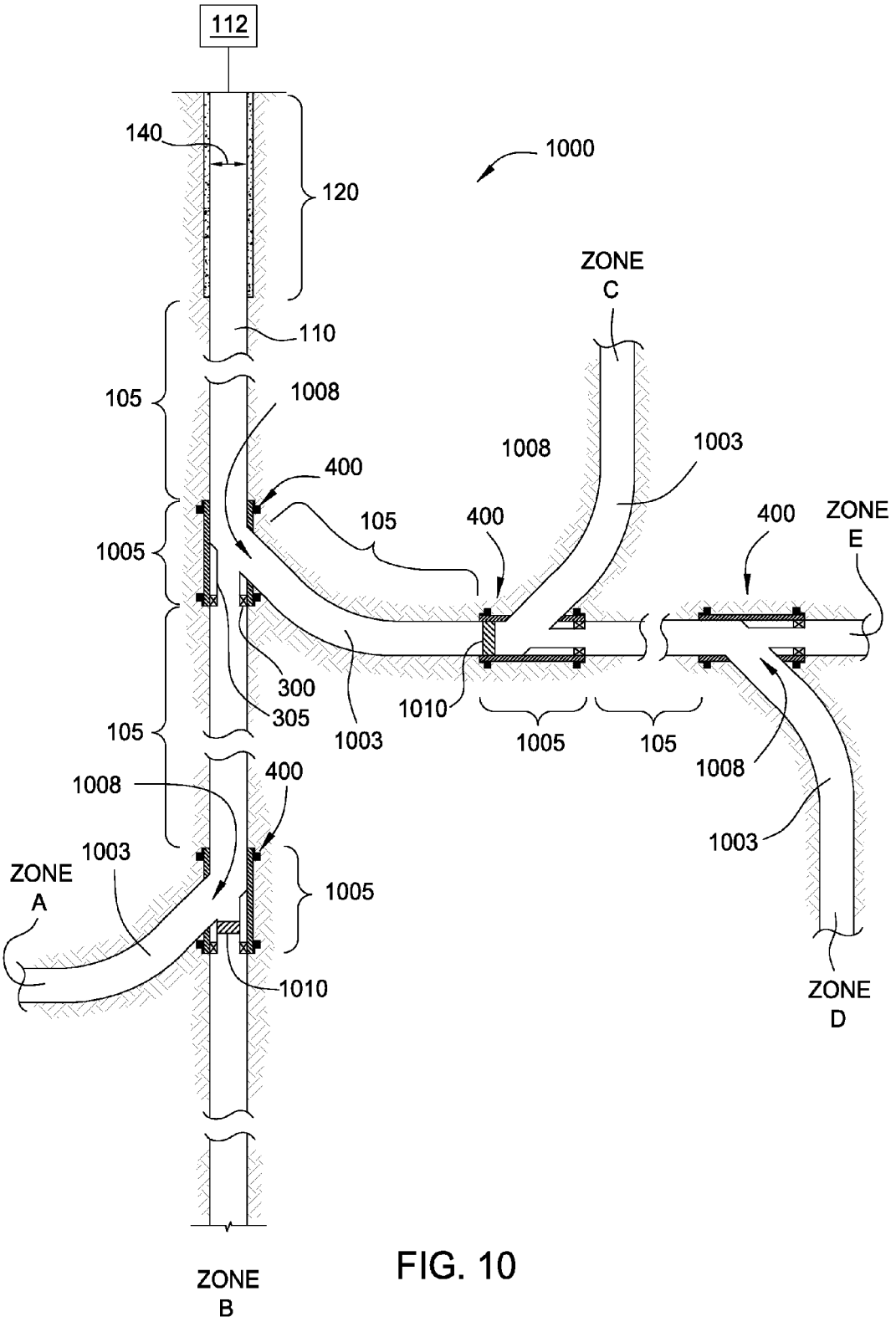
FIG. 10 is a cross-sectional view of an open hole production system according to embodiments described herein.

FIG. 10 is a cross-sectional view of an open hole production system 1000. The open hole production system 1000 includes a plurality of lateral wellbores 1003 branching from a primary wellbore 110. The lateral wellbores 1003 are formed through windows 1008 provided by a process described in FIGS. 3 and 4. The open hole production system 1000 also includes the primary wellbore 110 and a plurality of open hole sections 105 between sections of cladding 1005. The cladding 1005 may be the cladding 200 described in FIGS. 2-5, the cladding 700 described in FIG. 7, the cladding 800 described in FIG. 8, or the cladding 900 described in FIG. 9. Each of the regions comprising the cladding 1005 comprise an open hole junction 400.

Use of packers 300 and/or whipstocks 305 having through-bores in each open hole junction 400 allows production from various zones of the formation. Once a lateral wellbore 1003 is drilled, the cladding 1005 may be run through the window 1008. The cladding 1005 may be anchored in the open hole sections 105 beyond the window 1008 (within the lateral wellbore 1003), or somewhere above the window 1008 (such as in the open hole section 105). In one embodiment, the whipstock 305 may be retrieved to allow access to open hole sections 105 below or beyond the whipstock 305 (e.g., any one or combination of zones A-E). In another embodiment, if it is desired to regain access to the open hole sections 105 below or beyond the whipstock 305 (or provide fluid flow from any one or combination of zones A-E) a window may be milled through the whipstock 305 to provide access to the desired open hole section 105 below or beyond the whipstock 305, In another embodiment, if it is desired to regain access to the open hole sections 105 below or beyond the whipstock 305 (or provide fluid flow from any one or combination of zones A-E), a window may not be milled. Instead, perforations are shot and penetrate through the face of the whipstock 305, so allowing fluid to flow therethrough.

Seals 1010 may be positioned against the inner diameter of the cladding 1005 to provide selective production from zone A while zones B-E are isolated. The seals 1010 may be removed (e.g., by drilling) and placed in other positions within the cladding 1005 to produce from desired zones while isolating other zones. The monobore aspect of the open-hole/cladding (substantially the same diameters between the open hole sections 105 and the cladding 800) provides for the utilization of standard tools and equipment. The use of standard tools and equipment lowers production costs.

While the foregoing is directed to embodiments of the invention, other and further embodiments of the invention may be devised without departing from the basic scope thereof, and the scope thereof is determined by the claims that follow.

The invention claimed is:

1. A method for forming a lateral junction in an open hole section of a wellbore, comprising:

lowering a tubular member through a cased section of the wellbore;

expanding the tubular member in the open hole section of the wellbore, wherein an uncased section of the wellbore is disposed between the cased section and the tubular member such that the cased section is separated from the tubular member;

anchoring the tubular member directly to a wall of the open hole section of the wellbore;

forming a window in a sidewall of the tubular member; and drilling a lateral wellbore through the window.

2. The method of claim 1, wherein the tubular member comprises a hex shape after expansion.

3. The method of claim 1, wherein an uphole end of the tubular member includes a depth sensing device.

4. The method of claim 1, wherein an inner diameter of the cased section is substantially the same as an inner diameter of the wellbore.

5. The method of claim 4, wherein an inner diameter of the tubular member is substantially the same as the inner diameter of the wellbore.

6. The method of claim 1, wherein an outer surface of the first tubular includes one or more contact structures coupled thereto.

7. The method of claim 1, wherein the first tubular comprises an anchor section and a window section.

8. A method for forming a lateral junction in an open hole section of a primary wellbore, the method comprising:

drilling a primary wellbore to a first depth;

casing a first section of the primary wellbore from the surface to a second depth that is less than the first depth;

running-in a first tubular member through the first section and into the open hole section to a third depth that is less than the first depth and greater than the second depth;

expanding the first tubular directly against a wall of the open hole section of the primary wellbore;

forming a window in a sidewall of the first tubular; and drilling a second wellbore through the window.

9. The method of claim 8, wherein the first tubular member comprises a hex shape after expansion.

10. The method of claim 8, wherein an uphole end of the tubular member includes a depth sensing device.

11. The method of claim 8, wherein an inner diameter of the casing is substantially the same as an inner diameter of the primary wellbore.

12. The method of claim 11, wherein an inner diameter of the first tubular member is substantially the same as the inner diameter of the primary wellbore.

13. The method of claim 8, wherein an outer surface of the first tubular member includes one or more contact structures coupled thereto.

14. The method of claim 8, wherein the first tubular member comprises an anchor section and a window section.

15. The method of claim 8, further comprising:

running-in a second tubular through the first section, the first tubular and the window into the second wellbore;

expanding the second tubular against a wall of the second wellbore;

forming a window in a sidewall of the second tubular; and drilling a third wellbore through the window.

16. The method of claim 15, further comprising:

positioning a seal against a wall of the first tubular to isolate production from the second and third wellbores.

17. The method of claim 8, further comprising:

running-in a second tubular through the first section to a fourth depth that is greater than the first depth and less than the third depth;

expanding the second tubular against the wall of the open hole section of the primary wellbore;

forming a window in the sidewall of the second tubular; and drilling a third wellbore through the window.

18. A method for forming a lateral junction in an open hole section of a wellbore, the method comprising:

running-in a first tubular member through a cased section of a primary wellbore;

expanding the first tubular member in an open hole section of the primary wellbore thereby anchoring the first tubular member directly to a wall of the open hole section of the primary wellbore, wherein an uncased section of the primary wellbore separates the cased section and the first tubular member;

forming a window in a sidewall of the first tubular member; and drilling a first lateral wellbore through the window, wherein the first tubular member comprises at least one anchor section and a window section.

19. The method of claim 18, further comprising:

running-in a second tubular member through the first tubular member;

expanding the second tubular against the wall of the open hole section of the primary wellbore or the first lateral wellbore;

forming a window in a sidewall of the second tubular member; and drilling a third lateral wellbore through the window.

20. The method of claim 18, wherein the first tubular member comprises a hex shape after expansion.

* * * * *